US005121662A

United States Patent [19]

Wright

[11] Patent Number: 5,121,662

[45] Date of Patent: Jun. 16, 1992

[54] SECOND BITE PLIERS AND METHOD OF USE

[76] Inventor: William T. Wright, 106 Fernwood, Barberton, Ohio 44203

[21] Appl. No.: 724,727

[22] Filed: Jul. 2, 1991

[51] Int. Cl.[5] ..... B25B 7/00

[52] U.S. Cl. ..... 81/427.5; 81/300; 81/342

[58] Field of Search ..... 81/427.5, 318, 324, 81/331, 333, 342, 381, 300; 30/251

[56] References Cited

U.S. PATENT DOCUMENTS

| | | | |
|---|---|---|---|
| 643,061 | 2/1900 | Hukriede | 81/427.5 |
| 1,069,106 | 8/1913 | Brice | 81/324 |
| 1,294,689 | 2/1919 | Mellum | 81/331 |
| 1,368,244 | 2/1921 | Desrochers | 30/251 |
| 1,770,586 | 7/1930 | Troyer et al. | 81/300 |
| 2,822,715 | 2/1958 | Raimondi | 81/330 |
| 2,881,649 | 4/1959 | Ball et al. | 81/427.5 |
| 3,572,192 | 3/1971 | Juras | 30/251 |
| 4,554,848 | 11/1985 | Galletto | 81/318 |

FOREIGN PATENT DOCUMENTS

| | | | |
|---|---|---|---|
| 18694 | of 1897 | United Kingdom | 81/331 |

*Primary Examiner*—Frank T. Yost
*Assistant Examiner*—Hwei-Siu Payer
*Attorney, Agent, or Firm*—James D. Welch

[57] ABSTRACT

A system of pliers or the like, and "second bite" elements is disclosed. The pliers or the like are typically formed by at least two basic elements which are pivotally interconnected and which each have handle and jaw regions. Causing the handles of the pliers or the like to move toward one another also causes the jaws thereof to similarly move closer to one another by way of pliers action, or if an object is present between the jaws, more firmly grip the object. The second bite elements are pivotally attached to the end of one of the handles of the pliers or the like and interact with the other handle thereof to allow a user to more easily grip an object in the jaws of the pliers or the like by way of a force applied to the pliers or the like and the second bite elements. The system operates when a user causes the second bite elements to pivot with respect to one another and thereby interact with the handle of the pliers or the like to which they are not affixed, thereby causing the handles of the pliers or the like to pivot with respect to one another and by pliers action, cause the jaws of the pliers or the like to move closer to one another, or if an object is present between the jaws, cause the object to be more firmly gripped between the jaws.

7 Claims, 1 Drawing Sheet

SECOND BITE PLIERS AND METHOD OF USE

TECHNICAL FIELD

The present invention relates to pliers which are comprised of handles and jaws that are functionally interconnected so that when the handles thereof are caused to move toward one another by user action the jaws thereof are also forced toward one another, and more particularly to a "second bite" system which attaches to the pliers in a manner which allows a user thereof to more easily and conveniently apply an object gripping force to an object which is positioned within the jaws of the pliers, by way of plier action.

BACKGROUND

A common problem encountered by mechanics and others when using pliers is that it is often difficult to cause the jaws thereof to grip an object placed therein with sufficient force so that the jaws of the pliers do not slip with respect to the object, when a user attempts to move the object by way of the pliers. A familiar example is, for instance, encountered when pliers are applied to a the head of a bolt, which bolt is firmly secured in a nut. Even in the case in which the head of the bolt is easily accessible, it is often times very difficult to apply sufficient force to the handles of a typical pliers so that the head of the bolt is gripped firmly enough in the jaws of the pliers to allow it to be turned by the user, by way of the pliers. The problem is even more emphasised when the head of the bolt, or other object, is difficult to access. For instance, where a user is attempting to repair a plumbing pipe which is located in a cabinet, and where the only access to the pipe is from the back of the pipe, as viewed by the user from outside of the cabinet. In such a case it is often possible for a user to manipulate the pliers into a suitable position, but impossible for the user to reach the handles thereof in a manner which allows the user to impart sufficient force thereto, which force is translated into an object gripping force at the jaws of the pliers. As a result the pliers slip when a user attempts to turn the pipe fitting by way of the pliers.

In answer to the identified, or related, problem various inventors have developed various systems which aid a user of pliers in the application of required gripping force, via the jaws of pliers, to an object which the user thereof intends to move, by way of the pliers. In particular, a patent to Mellum, U.S. Pat. No. 1,294,689, teaches a pliers which comprises handles and jaws functionally interconnected very near the jaws so that when the handles thereof are forced together, the jaws thereof are likewise forced together. The basic pliers can be visualized as comprised of two basic elements, each having a relatively long handle region at one end thereof, and a relatively short jaw region at the other end thereof, with an angled region between the relatively long handle and relatively short jaw regions. The two elements are pivotally interconnected with one another near the jaws thereof and in the angled regions so as to form an "X" shaped formation therebetween. It is also noted that when assembled into a pliers the angled region of one basic element is oriented to project at an acute angle upward, and the angled region of the other basic element is oriented so as to project at an acute angle downward, when both basic elements are viewed with their relatively long handle regions oriented one above the other, essentially horizontally and in side elevation from a distance perpendicularly removed therefrom. The Mellum invention also comprises a third element applied to the pliers, which third element is pivotally interconnected with the handle of one of the two plier basic elements at some distance from the pivotal connection between the two basic elements. The third element has present, at its extent which projects nearest the jaw region of the pliers, teeth, which teeth are complimentary to teeth present on the outer edge of the jaw which is associated with the handle of the pliers to which the third element is not pivotally interconnected. In use one can grip the handles of the pliers and apply force thereto, thereby causing the handles to move toward one another, and by the action of the pliers, also cause the jaws thereof to move closer to one another, or if in contact with each other or an object placed therebetween, cause increased force to be applied thereto between the respective jaws. The teeth on the third element can then be caused to interact with the teeth on the edge of the jaw which is associated with the handle to which the third element is not pivotally interconnected, to retain the pliers in the position attained by user applied force. While the Mellum invention does not provide a means by which a user thereof can more easily apply the force which is required to cause the handles of the pliers involved to move toward one another, it does provide a locking mechanism of sorts which allows a user to position the pliers and cause them to retain said position without sustained effort, on the part of the user.

A British Patent, Number 18,694, teaches a system somewhat similar to the pliers system taught in Mellum, but the two basic elements are relatively straight. Near the jaw ends of the basic elements, however, the two basic elements are pivotally interconnected so that a user thereof can effect action of the combined system similar to that possible by a user of the Mellum invention. The difference between the Mellum and the British inventions is found in the way that the positioning of the two basic elements is secured after a user applied force causes the handles of the British invention to move toward one another which, by plier action, causes the jaws thereof to move closer together, or provide increased contact force therebetween, or provide increased gripping force to an object positioned within the jaws. The British invention teaches that a third element should be pivotally interconnected with one of the handles of the pliers much as is taught in the Mellum Patent, however, the British Patent teaches that a fourth element should also be present and pivotally interconnected with the second handle of the pliers. The third element is designed so that it can pivot to a position colinear with the handle to which it is pivotally interconnected, during initial use of the invention. The British Patent also teaches the presence of fifth and sixth elements. These elements are present on the ends of the handles of the invention. In use a user forces the handles sufficiently close to one another so that the fifth and sixth elements can be caused to interact and fix the handles in a stable position with respect to one another. The third and fourth elements of the British invention are then pivoted into cooperative position with respect to one another and made to interact so as to allow a user thereof to cause the handles of the invention to move even closer to one another. The interaction of the fifth and sixth elements secure the handles of the system allow the interaction between the third and fourth elements to be initiated. By fixing the relative positioning of the handles of the invention, the fifth and sixth elements allow a user the freedom to focus attention on the task of manipulating the fourth and fifth elements into a functionally cooperative interaction.

Another patent, U.S. Pat. No. 2,822,715 to Raimondi teaches a different approach to effecting an action which can effectively grip an object within the jaws of a pliers. The Raimondi invention, however, pivotally interconnects the basic elements thereof to one another at a position near the ends of the handles thereof. The jaws of the Raimondi system are located distally from their interconnection point, along the lengths of the basic elements. Projections are present on one of the so pivotally interconnected basic elements which encompasses the first basic element along the sides thereof to a point just short of the jaw region, and a cam-like lever is pivotally interconnected between the projections which further encompasses the first basic element at the top thereof. In use, an object is positioned in the jaws of the Raimondi system and the cam-like lever is caused to rotate, thereby forcing the basic element which is encompassed by the projections and the cam-like lever, closer to the basic element from which the projections originate. When the cam-like lever is sufficiently rotated it will be found to attain a relatively stable position in which it will maintain the relative position of the two basic elements with respect to one another without further user applied force being required. The Raimondi invention also includes an adjustment means by which the distance between the jaws at the initiation of the rotation of the cam-like lever can be set. This allows use of the Raimondi invention with objects of various size.

While the Raimondi invention arguably provides a system which makes it easier for a user to apply force to the jaws of a pliers or the like, via cam-like lever action, it teaches the requirement of a relatively complex, hence expensive, system. In addition, while the Mellum and British Patents teach inventions which can lock a pliers or the like in a certain position once achieved by user applied force, neither provide any mechanism which makes it easier to apply that force to the plier systems thereof, in the first place.

A need exists for a pliers system which is relatively simple in construction, hence economical to produce, and which makes it relatively easier for a user thereof to apply force to the handles of the pliers when the pliers is used to move an object which is positioned and gripped within its jaws. The system should also be applicable to plier-like systems such as tin-snips and channel locks.

DISCLOSURE OF THE INVENTION

The present invention provides a simple, hence, inexpensive system which when combined with a standard pliers enables a user thereof to relatively more easily apply force to the handles of the pliers which is sufficient to prevent slippage between the jaws of the pliers and an object positioned therein when the pliers are used to move the object.

A standard pliers is comprised of two basic elements. The elements are each comprised of various regions. At a minimum there are a handle region and a jaw region, and in many pliers there is an angled region separating the handle and jaw regions. In the following it will be assumed that an angled region is present, but this is not to be interpreted as a limitation of the present invention. The first basic element can be visualized in side elevation as viewed from a distance perpendicularly removed therefrom, as comprised of a relatively long, essentially horizontally oriented handle region which merges into an angled region that projects at an acute angle upwards, and which angled region merges into a relatively short essentially horizontally oriented jaw region. The second basic element is similar to the first except that the angled region projects downward at an accute angle when viewed in a manner similar to that described for the first basic element. The two basic elements are pivotally interconnected at a point near the jaws thereof, within the angled regions of each basic element when they are oriented so as to overlap, so that an "X" shaped formation is achieved, with the angled portion of the first basic element forming the one of the components of the "X" shape. and the angled portion of the other basic element forming the other component thereof. In use, it will be understood, a user of the so described pliers can effect a force between the jaws of the pliers be applying a force to the handles of the pliers which tends to cause the handles to move toward one another.

The present invention system requires that additional elements be added to a standard pliers as described above. In the most basic form of the present invention two additional elements are required. The first element is termed a first handle gripping element and it, as its name implies, firmly grips or attaches to one handle of a pliers, at the end thereof. Pivotally interconnected with the first element is a second element which is termed a second handle contacting element. In cross section this second element presents with an inverted "U" shape. In side elevation the second element is curved as viewed from a distance perpendicularly removed therefrom. In use the second handle contacting element is rotated around its interconnection point with the first handle gripping element toward the second handle of the pliers. The second handle contacting element contacts the second handle near the end thereof and encompasses it within the inverted "U" shape thereof which is visible in cross section. The second handle contacting element is, as mentioned above, curved as viewed in side elevation from a distance perpendicularly removed therefrom, and the curve is designed so that when the second handle contacting element is forced against the second handle of the pliers, the handles of the pliers are caused to move toward one another. It will be appreciated then, that the present invention provides a means of applying force to the handles of pliers which is different from the normal means of so doing. It is possible that the present invention will, in some cases, then, make applying force to a pliers which has the present invention incorporated easier. This would be the case, for instance, when it is easier, because of the location of an object which a user wishes to apply the pliers to, to apply force near the jaws of the pliers rather than at the handles thereof. Even in the case where an object to be moved by way of pliers is easy to access, it will be appreciated that the present invention makes it possible for a user to direct the force he or she applies to the handles of the pliers, by way of the first handle thereof and the second handle contacting element, in a more optimum manner. For instance consider the case where a bolt is to be removed from a nut and the jaws of a pliers is placed around the head of the bolt. A pliers without the present invention incorporated must be gripped by a user at the handles thereof, and squeezed together. The user must also push on one of the handles to attempt to turn the bolt. The squeezing force, it will be appreciated must be applied primarily to the ends of the handles in order for the user to obtain the best leverage as regards the bolt turning aspect of the task. A user can not easily apply his or her full hand to the task of squeezing the pliers system as a result. With the present invention incorporated into the pliers the user can squeeze together the first handle of the pliers and the second handle contacting element with his or her entire hand, as the contact point of the second handle contacting element is at the end of the second handle. As well, the first handle gripping element is attached to the end of the first handle. The user then, it will be appreciated, is able to make use of his or her full ability to squeeze the system with his or her full hand, and simultaneously push on the end of the first handle to cause the bolt to turn, for instance.

A second embodiment of the present invention achieves a similar functional result, but uses three essentially linear elements which are pivotally interconnected. A first handle gripping element is present and is very similar to the first handle gripping element of the first embodiment. An intermediate element is, however, pivotally interconnected to the first handle gripping element, and a second handle contacting element is pivotally interconnected to the intermediate element at the end of same which is opposite the end which is pivotally interconnected to the first handle gripping element. The second handle contacting element, again, presents an inverted "U" shape when viewed in cross section, and when the system of the three elements just introduced is caused to rotate toward the second handle of the pliers so that the second handle contacting element contacts the second handle of the pliers, the second handle of the pliers is again cradled within the inverted "U" shaped aspect of the second handle contacting element.

A third embodiment of the present invention is very similar to the second embodiment, but the second handle contacting element has notches therein near its pivotal interconnection point with the intermediate element, on the side thereof which encounters the second handle of the pliers when the three elements of the system are rotated toward the second handle of the pliers. Also, on the end of the second handle of the pliers is a rod which the notches on the second handle contacting element can interact with during use by a user.

The second and third embodiments of the present invention operate much the same as described with respect to the first embodiment, but the third embodiment provides a more definite interaction between the pin on the second handle of the pliers and the notches of the second handle contacting element.

It should be understood that the present invention is a combination of a standard pliers and a system which modifies how force is applied to the handles of said standard pliers. The resulting interaction of the standard pliers and the new elements of the present invention provides a user of the new invention a means by which to more easily apply force to the handles of a pliers to which has been added the new elements taught by the present disclosure. In addition, it is to be understood that the new elements of the present invention can also be applied to plier-like mechanisms such as tin-snips and channel locks etc.

It is also mentioned that the second bite elements of the present invention can be included at the original manufacture of a pliers or the like, or provided to an existing standard pliers by retro-fit.

SUMMARY OF THE INVENTION

A common problem faced by users of pliers or the like is that it is difficult to apply sufficient force to the handles thereof so that an object gripped within the jaws of the pliers does not slip with respect to the jaws when a user attempts to effect a change to the object by way thereof.

Various inventions have been taught by inventors, the application of which to standard pliers or the like allows a user of said standard pliers or the like to more easily apply force to the handles of the pliers, or which allow a clamping action that serves to retain a grip on an object, by the jaws of the pliers or the like, once established by user action.

While the prior teachings provide inventions with utility, none of which the Inventor herein is aware at once teach an invention which is simple and economical to produce, and simultaneously provides a means by which a user thereof can more easily apply force to the handles of a pliers or the like. It is also noted that prior teachings are not readily applied to existing pliers and the like by retro-fit.

The present invention is at once simple and economical to produce and apply to pliers or the like, and provides a user thereof a means by which to more easily apply force to the handles of a pliers or the like which has been modified by addition of the second bite elements of the present invention. In addition, the teachings of the present invention are easy to apply to existing standard pliers or the like.

It is therefore a purpose of the present invention to provide a simple economical to produce system.

It is another purpose of the present invention to provide a system which is easy to apply to standard existing pliers or the like by retro-fit and which can also be implemented into new pliers or the like during original manufacture.

It is yet another purpose of the present invention to provide a system which provides the user of pliers or the like a means by which he or she might more easily apply force to the handles of a pliers or the like and thereby, by the action of the pliers or the like more firmly grip an object positioned in the jaws of the pliers, or the like, into which the second bite elements of the new invention have been incorporated.

It is also another purpose of the present invention to teach a method, the practice of which by a user of pliers or the like might allow him or her to more easily effectively apply force to the handles thereof during use.

DETAILED DESCRIPTION

Figure 1A:
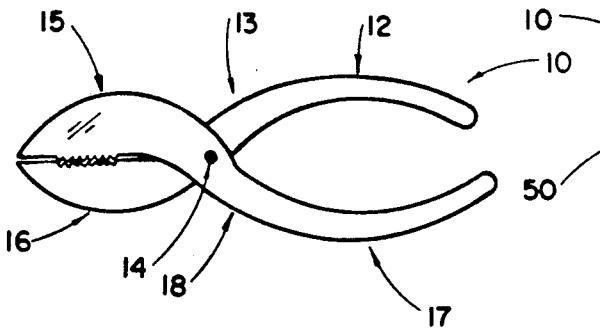
FIG. 1a PRIOR ART
FIG. 1*a* shows a basic pliers in side elevation.
Figure 1B:
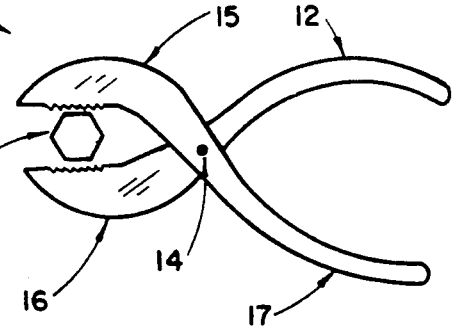
FIG. 1b PRIOR ART
FIG. 1*b* shows a basic pliers in side elevation, with an object grippred within the jaws thereof.

Referring now to FIG. 1*a*, there is shown a basic pliers (10). Two basic elements are shown pivotally interconnected with one another by pivot means (14). One basic element is comprised of a first handle (17), which first handle (17) merges into an angled region (18), which angled region (18) merges into a jaw (15). The second basic element is comprised of a second handle (12), which second handle (12) merges into an angled region (13), which angled region (13) merges into a jaw (16). It should be readily appearant from FIG. 1*a* that if the first and second handles (17) and (12) respectively are moved apart from one another by rotation about the pivot means (14), then the corresponding jaws (15) and (16) respectively will also move apart from one another as a result of plier action. Likewise, moving the handles (17) and (12) toward one another by rotation about pivot means (14) causes the jaws (15) and (16) to move closer to one another, or if already touching one another, said motion of the handles will cause an increased force between the jaws at their point of contact with one another. If an object is positioned within the jaws, said force will serve to grip the object between the jaws. FIG. 1*b* shows an object (50) between the jaws (15) and (16) of pliers (10).

In use a pliers as illustrated in FIG. 1*b* can be difficult to use in that a gripping force between an object (50) and the jaws (15) and (16) can be difficult for a user to apply via the technique of squeezing first and second handles (17) and (12) toward one another. This can occur, for instance, where the object (50) is the head of a bolt or a plumbing fitting which is positioned in a hard to access location.

Figure 2A:
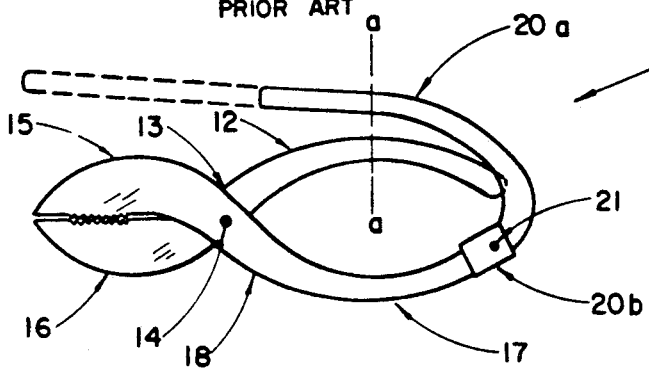
FIG. 2*a* shows a basic pliers as in FIG. 1*a*, with second bite system elements incorporated therein to form a first embodiments of the present invention.
Figure 2B:
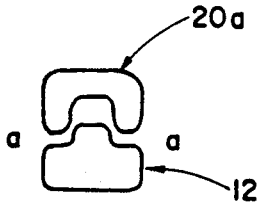
FIG. 2*b* shows a cross sectional view taken at point a—a on FIG. 2*a*.

FIG. 2*a* shows a system (20) which comprises a pliers (10) to which has been applied a "second bite" system of elements, (20*a*) and (20*b*). Note that the basic elements of the pliers as indicated by (10) in FIG. 1*a* are the same in FIG. 2*a*. What is added to the pliers of FIG. 1*a* in FIG. 2*a* is a series of two elements, namely a first handle gripping element (20*b*) and a second handle contacting element (20*a*), which series of two elements are interconnected by a pivot means (21). FIG. 2*b* shows a cross sectional view of a portion of the second handle (12) of the basic pliers and of the second handle contacting element (20*a*). Note that the second handle contacting element provides a cross sectional inverted "U" shape which is designed to fit over the pliers second handle (12) when contacting same. Note also, in FIG. 2*a*, that the second handle contacting element is curved in shape when viewed in side elevation from a distance perpendicularly removed therefrom. From inspection of FIG. 2*a* it should be readily obvious that plier jaws (15) and (16) can be forced toward one another or caused to be more forcefully in contact with one another by squeezing second handle contacting element (20*a*) toward the first plier handle (17). A user can easily do this with one hand in much the same way as he or she would do the two handles of the pliers were the second bite elements not present. Note, however, that the second handle contacting element (20*a*) is formed so that it contacts the second handle (12) of the pliers (10) at the end thereof. Thus all force applied by a user by squeezing the second handle contacting element (20*a*) toward the first handle (17) of the pliers (10) is effectively applied at the end of the second handle (12) of the pliers (10) along a locus of points on the second handle contacting element (20*a*). Also note that the first handle gripping element (20*b*) is attached to the end of the first handle (17) of the pliers (10). This arrangement adds leverage over that which can be developed by performing a similar action on a pliers without the second bite elements (20*a*) and (20*b*) in place. If an object (50) is positioned within the jaws (15) and (16) of the pliers (10) which have the second bite elements (20*a*) and (20*b*) in place, as demonstrated in FIG. 2*a*, it will be more securily gripped as a result of a definite amount of user applied force applied to the system than if the second bite elements (20*a*) and (20*b*) are not present. In addition, the second bite elements (20*a*) and (20*b*) allow a user to apply force near the jaws (15) and (16) of pliers (10) to which have been applied the second bite elements (20*a*) and (20*b*) because the second handle contacting element (20*a*) projects forward to a point near or even possibly beyond (shown by a dotted line in FIG. 1*a*), the jaw (15) of pliers (10). This may allow a user to apply force to the pliers (10) which might not be possible were the second bite elements (20*a*) and (20*b*) not present, such as where the pliers (10) are used in a very tight space. A common example might occur where a user wishes to repair plumbing pipes inside a cabinet. A fitting might be present behind a barrier which allows the pliers (10) to have access thereto only from behind the fitting, as viewed by the user who is situated in front of the pipes outside the cabinet. It might be possible for such a user to position the jaws (15) and (16) of the pliers (10) on the fitting, but impossible for him or her to reach the handles (12) and (17) of the pliers (10) and apply the required force thereto to securely grip the fitting, then turn it by way of the pliers (10). However, it might be possible for the user to apply the required force to the second handle contacting element (20*a*) which is accessible near the jaw (15) of the pliers.

Figure 3A:
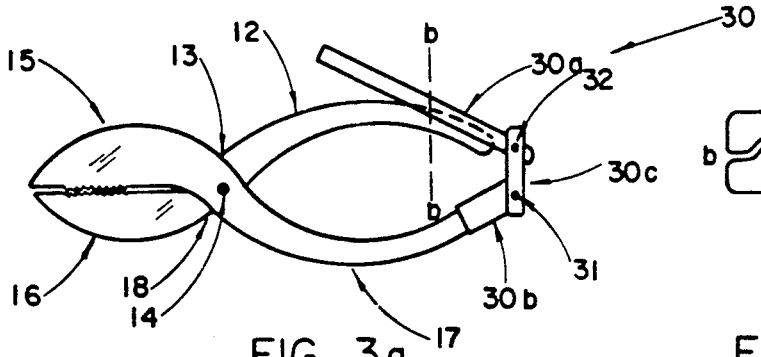
FIG. 3*a* shows a basic pliers as in FIG. 1*a*, with second bite system elements incorporated therein to form a second embodiment of the present invention.
Figure 3B:
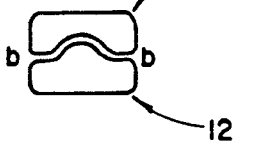
FIG. 3*b* shows a cross sectional view taken at point b—b in FIG. 3*a*.

Turning now to FIG. 3*a*, a second embodiment of the same invention is shown. Note that the basic pliers (10) is the same as shown in FIG. 1*a*. However, the second bite elements (30*a*), (30*b*) and (30*c*) are a bit different from those shown in FIG. 2*a*, e.g. (20*a*) and (20*b*). The resulting system is identified by the numeral (30). In particular note that there are three elements in the second bite system shown in FIG. 2*a*. Also note that the three elements of the second bite system shown in FIG. 3*a* are basically of linear design. The first handle gripping element (30*b*) is basically the same as its counterpart (20*b*) shown in the embodiment shown in FIG. 2*a*. However, it is pivotally interconnected to an intermediate element (30*c*) by pivot means (31), and the other end of intermediate element (30*c*) is interconnected to the second handle contacting element of the second embodiment (30*a*) by pivot means (32). Note that FIG. 3*b* shows that the second handle contacting element (30*a*) provides an inverted "U" shape in cross section similar to that shown in FIG. 2*b* for the first embodiment of the present invention. The purpose of the inverted "U" shape observed in cross section is the same as described with respect to the FIG. 2*b* depicted embodiment, and the overall operation of the embodiment shown in FIG. 3*a* is essentially the same as that described for the first embodiment depicted in FIG. 2*a*. The actual component actions during use are a bit different, with a curved second handle contacting element (20*a*) being replaced by a two section pivoted system comprised of (30*a*) and (30*c*), but the end result is similar to that described above. In effect, the curve of the second handle contacting element (20*a*) of the first embodiment is replaced by a pivot interconnection of two elements (30*a*) and (30*c*), which simulates a curved structure, in the second embodiment.

Figure 4A:
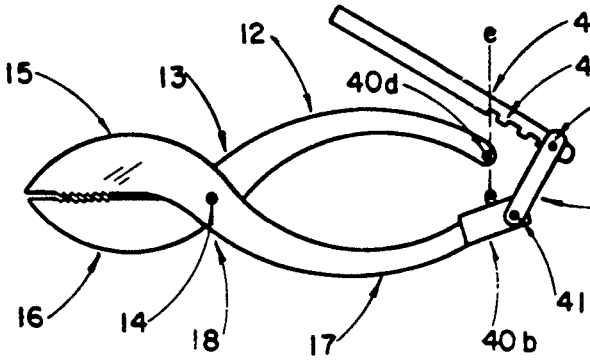
FIG. 4*a* shows a basic pliers as in FIG. 1*a*, with second bite system elements incorporated therein to form a third embodiment of the present invention.
Figure 4B:
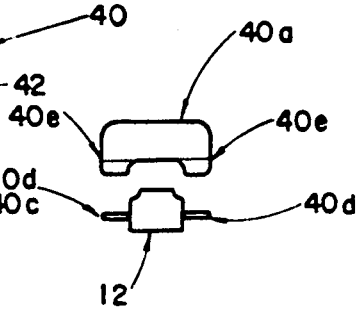
FIG. 4*b* shows a cross sectional view taken at point c—c in FIG. 4*a*.

A third embodiment of the same invention is shown in FIG. 4*a*. The overall third embodiment system is identified by the numeral (40). Note that the standard pliers (10) is still present. Note also that the three element second bite system shown in FIG. 3*a* is again present. The three elements being the first handle gripping element (40*b*), the intermediate element (40*c*) and the second handle contacting element (40*a*), which elements are interconnected by pivot means (41) and (42) as shown in FIG. 4*a*. The difference between the second embodiment shown in FIG. 3*a* and the third embodiment shown in FIG. 4*a*, is the presence of notches (40*e*) in the second handle contacting element, and the presence of a pin (40*d*) in the end of the second handle (12) of the pliers (10). The functional aspects of the fourth embodiment of the invention are nearly identical to those described regarding the third embodiment, but with the added ability of the notches (40*e*) in the second handle contacting element to more definitely interact with the pin (40*d*) in the end of the second handle (12) of the pliers (10) being also available. Also note that FIG. 4*b* shows that the second handle contacting element again provides an inverted "U" shape when viewed in cross section. FIG. 4*b* also shows the presence of the notches (40*e*) in second handle contacting element (40*a*) and the pin (40*d*) in the end of the second handle (12) of the pliers (10). It is to be understood that the notches (40*e*) and rod (40*d*) can also be applied to the first embodiment of the invention which first embodiment, without the notches, is demonstrated in FIG. 1*a*.

Finally, while the examples of the present invention in this disclosure have focused upon use of second-bite elements with a standard pliers, it is to be understood that the term "pliers" is to be interpreted to include any functionally equivalent system which can be used to grasp an object within jaws and which can be functionally fitted with second-bite elements. Such equivalent systems include channel locks which provide multiple jaw sizes, nut crackers, tin snips etc. Note in particular that in the case of a nut cracker, the jaws of thereof will be pivotally interconnected to one another at the ends thereof, rather than at some point near the jaws thereof which merges into the handles thereof. The action of such a system is to be understood to be within the functional description of pliers action in that causing the handles thereof to come into closer proximity with respect to one another also causes the jaws thereof to come closer to one another, or to more firmly grip an object within said nut cracker jaws. The claims are to be interpreted to include such a system. Also, while a pliers or the like has been described herein as comprised of two basic pivotally interconnected elements, it is to be understood that the second bite elements can be applied to a pliers or the like which include more than two basic elements. Again, the claims are to be interpreted to include such.

Having hereby disclosed the subject matter of this invention, it should be obvious that many modifications, substitutions, and variations are possible in light of the teachings. It is therefore to be understood that the invention may be practiced other than as specifically described, and should be limited in breadth only by the claims.

I claim:

1. Pliers having two basic elements, the first of which basic elements is comprised of a first handle which merges into a first jaw, and the second of which basic elements is comprised of a second handle which merges into a second jaw, the handles of which basic elements are of essentially equal length; which first and second basic elements are pivotally interconnected with one another at a point near the jaws thereof such that causing the ends of the handles of the respective pivotally interconnected basic elements to become further removed from one another by rotation around their pivotal interconnection point, causes the jaws thereof to likewise necessarily become further removed from one another, and vice versa by plier action; the improvement comprising:

a first handle gripping element and a second handle contacting element; which first handle gripping element provides pivot means at the end of the first handle of the pliers for functionally pivotally interconnecting the second handle contacting element with the end of the first handle of the pliers; which second handle contacting element is functionally pivotally interconnected with the end of the first handle of the pliers; and which second handle contacting element is curved in shape such that when the second handle contacting element is rotated about its functional pivotal interconnection point with the end of the first handle of the pliers, toward the second handle of the pliers, it will contact the end of the second handle of the pliers on the concave side of said curved shape.

2. The pliers as in claim 1 which further comprise notches on the second handle contacting element and a rod in the end of the second handle of the pliers such that when the second handle contacting element is rotated toward the end of the second handle of the pliers and contacts same, the notches thereon interact with the rod in the end of the second handle of the pliers to provide a more definite interaction between the second handle contacting element and the second handle when used by a user of the system as described in claim 1.

3. The pliers as in claim 1 in which the second handle contacting element presents an inverted "U" shape in cross section, which inverted "U" shape serves to cradle the second handle at its contact point locus therewith.

4. Pliers having two basic elements, the first of which basic elements is comprised of a first handle which merges into a first jaw, and the second of which basic elements is comprised of a second handle which merges into a second jaw, which first and second basic elements are pivotally interconnected with one another at a point near the jaws thereof such that causing the ends of the handles of the respective pivotally interconnected basic elements to become further removed from one another by rotation around the pivotal interconnection point of the two basic elements, causes the jaws thereof to likewise necessarily become further removed from one another, and vice versa by plier action; the improvement comprising:

a first handle gripping element, an intermediate element and a second handle contacting element; which first handle gripping element provides pivot means at the end of the first handle of the pliers for functionally pivotally interconnecting the intermediate element with the end of the first handle of the pliers; which second handle contacting element functionally pivotally interconnects with the intermediate element, and which intermediate element, at an end of said intermediate element not functionally pivotally interconnected with the second handle contacting element, functionally pivotally interconnects with the end of the first handle of the pliers; such that the second handle contacting element can be rotated about its functional pivotal interconnection point with the intermediate element and/or the intermediate element can be rotated about its functional pivotal interconnection point with the end of the first handle of the pliers so that the second handle contacting element contacts the second handle of the pliers;

5. The pliers as in claim 4 in which the second handle contacting element presents an inverted "U" shape in cross section, which inverted "U" shape serves to cradle the second handle at its contact point locus therewith.

6. The pliers as in claim 4 which further comprise notches on the second handle contacting element and a rod in the end of the second handle of the pliers such that when the second handle contacting element is rotated toward the end of the second handle of the pliers and contacts same, the notches thereon interact with the rod in the end of the second handle of the pliers to provide a more definite interaction between the second handle contacting element and the second handle when used by a user of the system as described in claim 4.

7. A method of applying pliers to an object which allows a user of said pliers to more easily apply the required force thereto to securily grip an object within the jaws of said pliers which comprises the steps of:

a. providing pliers, which pliers are comprised of two basic elements, the first of which basic elements comprises a first handle which merges into a first jaw, and the second of which basic elements comprises a second handle which merges into a second jaw, the handles of which basic elements are of essentially equal length; which first and second basic elements are pivotally interconnected to one another near the jaws thereof such that causing the ends of the handles of the pivotally interconnected basic elements to become further removed from one another by rotation around their pivotal interconnection point, causes the jaws thereof to likewise necessarily become further removed from one another, and vice versa by plier action;

b. affixing a second bite system of elements to said pliers, which second bite system of elements comprises, at a minimum, a first handle gripping element and a second handle contacting element; which first handle gripping element provides pivot means at the end of the first handle of the pliers, and which second handle contacting element is directly or indirectly pivotally interconnected with the end of the first handle of the pliers, such that the second handle contacting element can rotate about the pivot means at the end of the first handle of the pliers and contact the second handle of the pliers;

c. positioning an object within the jaws of the pliers; and d. applying a force or forces to the first handle of the pliers and the second handle contacting element when it is rotated to contact the second handle of the pliers, which force or forces cause said elements to move toward one another, thereby causing the handles of the pliers to move toward one another by rotation around their pivotal interconnection point, such that, by plier action, the object is gripped by the jaws of the pliers.

* * * * *